US007130137B2

(12) United States Patent
Natsume

(10) Patent No.: US 7,130,137 B2
(45) Date of Patent: Oct. 31, 2006

(54) METHOD OF DESIGNING REFLECTIVE SURFACE OF REFLECTOR IN VEHICLE LAMP

(75) Inventor: Kazunori Natsume, Shimizu (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 5 days.

(21) Appl. No.: 10/246,423

(22) Filed: Sep. 19, 2002

(65) Prior Publication Data

US 2003/0053230 A1 Mar. 20, 2003

(30) Foreign Application Priority Data

Sep. 19, 2001 (JP) ..... P2001-285692

(51) Int. Cl.
*F21V 7/09* (2006.01)
*F21S 8/10* (2006.01)

(52) U.S. Cl. ..... 359/900; 359/869; 362/518

(58) Field of Classification Search ..... 359/869, 359/868; 362/459, 505–507
See application file for complete search history.

(56) References Cited

U.S. PATENT DOCUMENTS

| | | | | |
|---|---|---|---|---|
| 3,710,095 | A | 1/1973 | Donohue et al. | |
| 4,864,520 | A | 9/1989 | Setoguchi et al. | |
| 5,034,867 | A | 7/1991 | Mayer | |
| 5,056,045 | A | 10/1991 | Ohsawa | |
| 5,096,281 | A * | 3/1992 | Windebank et al. | 359/868 |
| 5,255,352 | A | 10/1993 | Falk | |
| 5,483,430 | A | 1/1996 | Stapel et al. | |
| 5,539,629 | A | 7/1996 | Chinniah et al. | |
| 5,687,737 | A | 11/1997 | Branham et al. | |
| 5,864,342 | A | 1/1999 | Kajiya et al. | |
| 5,876,114 | A * | 3/1999 | Nino | 362/518 |
| 5,954,427 | A | 9/1999 | Campos et al. | |
| 6,128,631 | A | 10/2000 | Wallace et al. | |
| 6,493,096 | B1 * | 12/2002 | Maeda et al. | 356/612 |
| 2001/0009354 | A1 * | 7/2001 | Natsume | 315/77 |
| 2003/0101032 | A1 | 5/2003 | Natsume et al. | |
| 2003/0202349 | A1 | 10/2003 | Suehiro et al. | |
| 2003/0214734 | A1 | 11/2003 | Nishioka et al. | |
| 2003/0214736 | A1 | 11/2003 | Yoshikawa et al. | |
| 2004/0189944 | A1 | 9/2004 | Kaufman et al. | |
| 2005/0034080 | A1 | 2/2005 | Jaeger | |
| 2005/0213820 | A1 | 9/2005 | Liu et al. | |

FOREIGN PATENT DOCUMENTS

| | | | |
|---|---|---|---|
| DE | 10048142 | A1 | 4/2001 |
| DE | 10102148 | A1 | 8/2001 |
| JP | 2001101912 | A * | 4/2001 |

* cited by examiner

*Primary Examiner*—Drew A. Dunn
*Assistant Examiner*—Mark Consilvio
(74) *Attorney, Agent, or Firm*—Sughrue Mion, PLLC

(57) ABSTRACT

The method of designing a reflective surface of a reflector in a vehicle lamp according to the present invention comprise (1) a segment creating step of sectioning a free curved surface and creating a plurality of segments having a plurality of vertexes, and (2) a curved surface generating step of deciding the light reflecting direction at each one of the plurality of vertexes, and generating curved surfaces to be assigned to the segments based on the reflecting direction for each one of the plurality of segments. The present invention provides a method of designing a reflective surface of a reflector in a vehicle lamp whereby the controllability of the luminous intensity distribution pattern is improved.

13 Claims, 14 Drawing Sheets

METHOD OF DESIGNING REFLECTIVE SURFACE OF REFLECTOR IN VEHICLE LAMP

BACKGROUND OF THE INVENTION

1. Field of the Invention

The present invention relates to a method of designing reflective surface of reflector in vehicle lamp which is used for such vehicles as automobiles.

2. Description of the Related Art

A vehicle lamp is comprised of a light source, reflector, and lens. In such a vehicle lamp, a light from the light source enters the reflective surface of the reflector. This incident light is reflected at each segment of the reflective surface in a reflecting direction which is determined by the surface shape of the respective segment, is transmitted through the lens, and is emitted to outside the lamp.

In such designing of a vehicle lamp, not only the conditions from the aspect of the functions of a lamp (functional constraints), but also the conditions from the aspect of shape to be used in a state mounted on such a vehicle as an automobile (shape constraints), and the conditions from the aspect of appearance (appearance constraints), are imposed. Therefore it is demanded to design a lamp that satisfies the constraints of the required shape and appearance first, then optimize the conditions from the aspect of function.

The functional constraints are, for example, light uniformity, so that the entire lamp illuminates uniformly, and the light diffusion, so that light is appropriately diffused and illuminates in various directions, depending on the type of lamp. The shape constraints are, for example, the conditions due to the capacity and shape of the lamp housing section of the car body, and the shape of the outer face of the lamp (outer surface of the lens) which continues with the other parts of the car body. The appearance constraints are, for example, the conditions due to the balance with the appearance of the other parts of the car body and the requirements in the design aspects of the car body.

SUMMARY OF THE INVENTION

As a result of studying the above mentioned prior art, the inventors discovered the following problems. In other words, recently strict shape constraints, such as an even less thickness of the lamp, are demanded because of the further restrictions in the lamp housing section in terms of car body configuration and placing more importance on the design of vehicles. Because of such demands, a reflector where the basic shape of the reflecting surface is a free curved surface has been proposed. If a free curved surface is used, supporting shape constraints, such as a thinner lamp, can be relatively easy because of the flexibility in design.

However, if the basic shape of the reflective surface is a free curved surface, then controllability of the luminous intensity distribution pattern is poor in the case of a design method for assigning a geometric surface, such as paraboloid of revolution, to each segment of the free curved surface, because flexibility in controlling the reflecting direction of light is small.

To solve the above problems, it is an object of the present invention to provide a method of designing reflective surface of reflector in vehicle lamp so as to improve controllability of the luminous intensity distribution pattern.

A method of designing a reflective surface of a reflector in a vehicle lamp according to the present invention comprises, (1) a segment creating step of sectioning a free curved surface and creating a plurality of segments which have a plurality of vertexes, and (2) a curved surface generating step of deciding the light reflecting direction at each one of the plurality of vertexes and generating curved surfaces to be assigned to the segments based on the reflecting direction for each one of the plurality of segments.

In this method, a reflecting direction of light at each vertex of each segment of the free curved surface is determined first, and based on this reflecting direction, the curved surface to be assigned to each segment is generated. By determining the reflecting direction of each vertex of the segment to a desired direction and generating the curved surface based on this, the light reflecting direction in each segment can be controlled to be a desired range, and as a result, the controllability of the luminous intensity distribution pattern can be improved.

In the above mentioned curved surface generation step, the two independent curved surface generation directions may be decided at the vertex for generating the curved surface to be assigned to the segment based on the reflecting direction decided for the vertex, so that the curved surface to be assigned to the segment is generated based on the curved surface generation directions determined for the plurality of vertexes respectively. By determining the curved surface generation direction for the plurality of vertexes of the segment respectively and generating the curved surface based on the directions in this way, the curved surface to be assigned to the segment can be easily generated.

Also in the above mentioned curved surface generation step, the curved surface to be assigned to the segment may be generated based on a cubic hyperboloid. Then the curved surface can be efficiently generated.

In this case, for a vertex shared by adjacent segments, the reflecting directions may be the same. Then the boundary of the reflective surfaces between the adjacent segments become continuous, and a smooth reflective surface can be obtained.

Also for a vertex shared by adjacent segments, the reflecting directions maybe different. Then the boundary of the reflective surfaces between the adjacent segments become discontinuous, and a discontinuous reflective surface may be obtained.

Also in the above mentioned curved surface generating step, the light reflection characteristic of the generated curved surface may be evaluated. Then the light diffusion range and the reflection characteristic, such as the density of beams, of the curved surface to be assigned to the segment can be confirmed.

The segment creating step may further comprise a reference plane specifying step of specifying a reference plane facing the free curved surface, and a reference segment creating step of specifying a reflecting surface outline on the reference plane, and creating a plurality of reference segments by sectioning the inside of the reflecting surface outline, so that the plurality of segments are created by projecting the plurality of reference segments onto the free curved surface. By this, it is possible to design the segments to be created on the free curved surface on the reference plane, which makes the design operation simpler.

In the reference segment creating step, the inside of the reflecting surface outline may be sectioned in a first direction and a second direction which is perpendicular to the first direction, so that the plurality of reference segments, where each one of the reference segments is a rectangle, are created.

Or, in the reference segment creating step, the inside of the reflecting surface outline may be sectioned along the radial directions, radially stretched from a predetermined position in the reflecting surface outline as the center, and the circumferential directions which are concentric circles where the predetermined position is the center, so that the plurality of reference segments, where each one of the reference segments is a sector, are created.

For the configuration of segments which section the free curved surface, the shape of each segment is the above mentioned rectangle or sector, for example. The segment configuration based on such a regular array is preferable in terms of the appearance of the reflector. However, various segment structures other than the above mentioned structure can be applied here.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
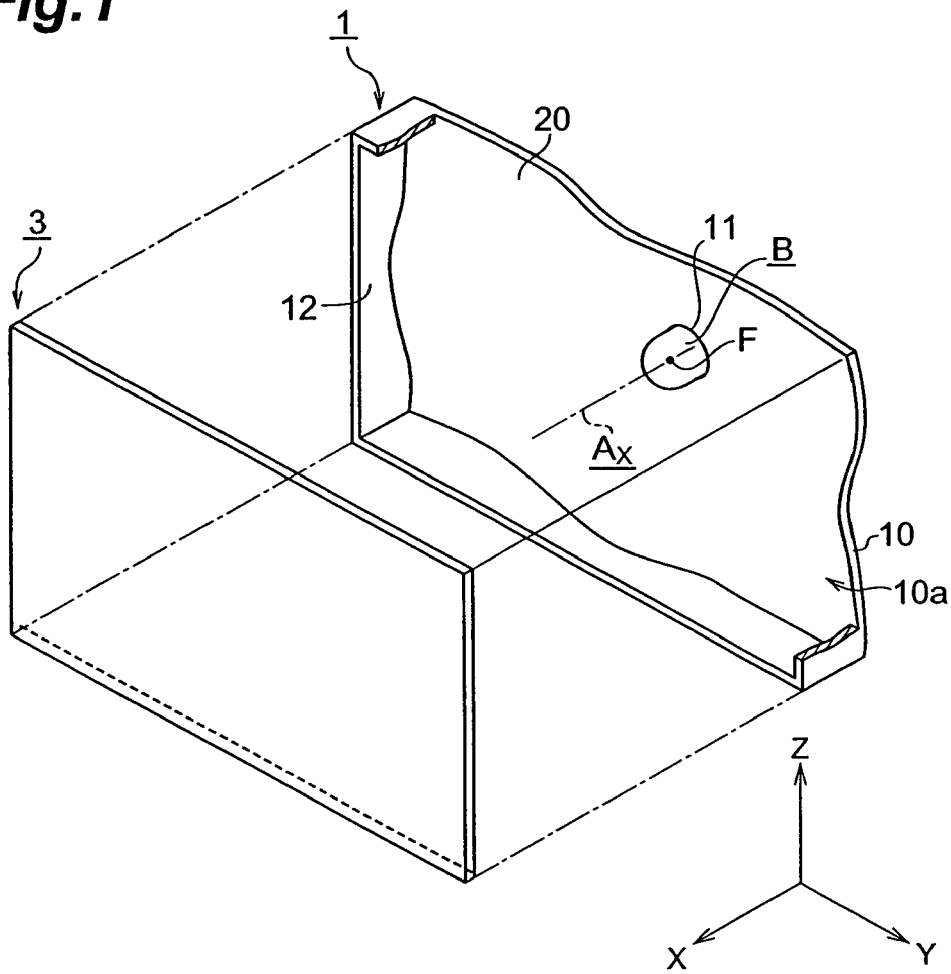
FIG. 1 is an exploded perspective view showing the configuration of an embodiment of the vehicle lamp where a part is cut away.

Embodiments of the method of designing a reflective surface of a reflector in the vehicle lamp according to the present invention will now be described with reference to the accompanying drawings. In the descriptions of the drawings, the same composing elements are denoted with a same symbol, where redundant descriptions are omitted. The dimensional ratios in the drawings do not always match those in the descriptions.

Figure 2:
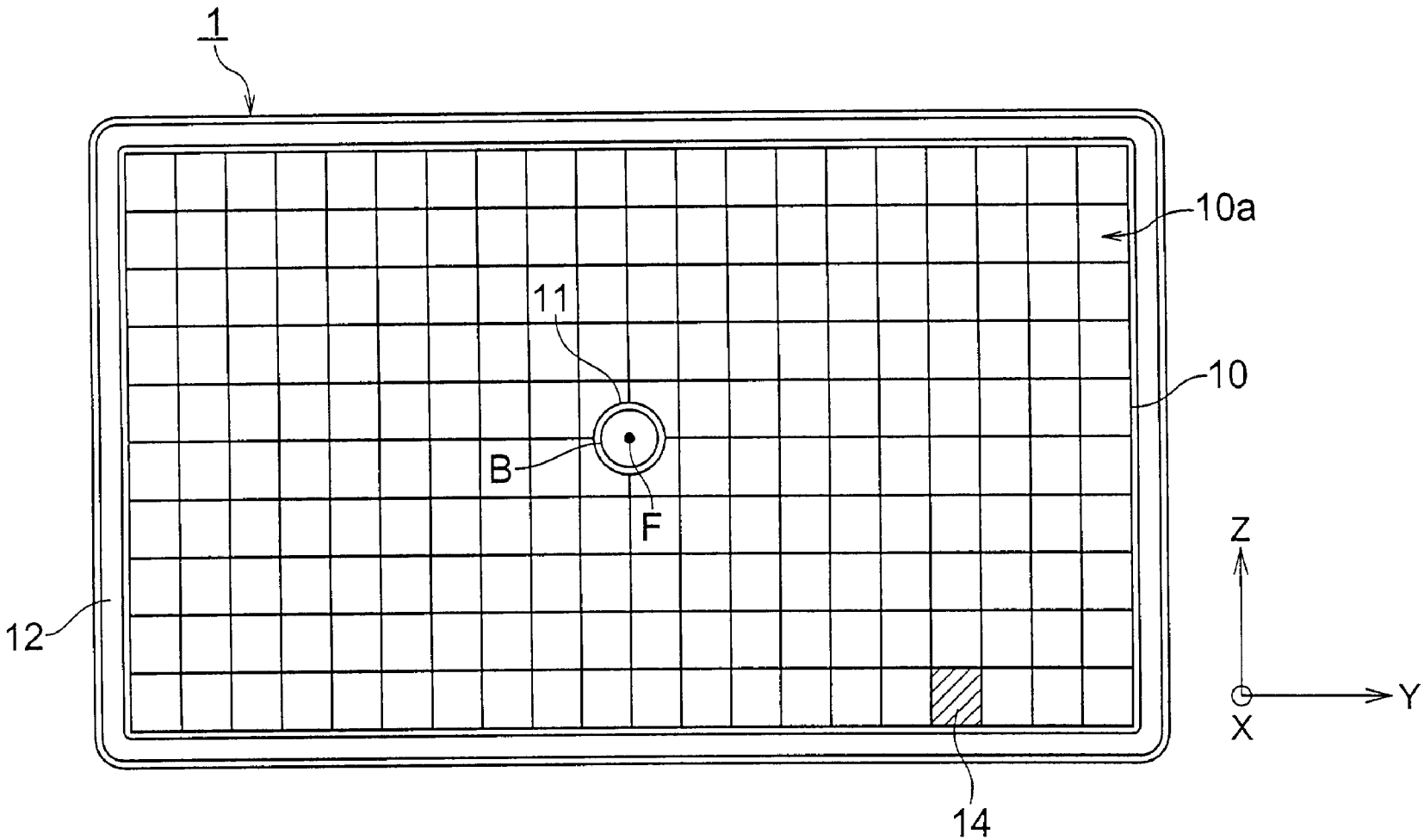
FIG. 2 is a plan view showing the configuration of the reflector of the vehicle lamp shown in FIG. 1.

FIG. 1 is an exploded perspective view showing the configuration of an embodiment of a vehicle lamp comprising a reflector, where a part is cut away. This reflector of the vehicle lamp has a reflective surface designed by the method of designing a reflective surface of a reflector in a vehicle lamp according to the present invention. FIG. 2 is a plan view showing the configuration of the reflector in a vehicle lamp shown in FIG. 1. In the following, the coordinate axis of the XYZ system is defined as shown in FIG. 1 and FIG. 2, where the fore and aft directions, which is the optical axis Ax direction of the lamp, is the X axis, the horizontal direction of the lamp is the Y axis, and the vertical direction thereof is the Z axis.

The vehicle lamp according to the present embodiment is applied to, for example, a marker light, such as the tail lamp of an automobile, and this lamp is comprised of a reflector 1, lens 3, and light source B, as shown in FIG. 1.

The reflector 1 is created roughly in a vertical direction with respect to the optical axis Ax in roughly a rectangular shape when viewed from the X axis direction. The optical axis Ax is set in advance considering the fore and aft directions of the vehicle, where the lamp is installed, and the light projection direction of the lamp. This reflector 1 is comprised of a reflecting mirror section 10 where the surface facing the lens 3 is the reflective surface 10*a* to reflect light, and an enclosure section 12 which is installed surrounding the reflective surface 10*a* for positioning and securing the lens 3.

The lens 3 is installed roughly vertically with respect to the optical axis Ax. This lens 3 is a through lens without steps, since the reflective surface 10*a* of the reflector 1 has a diffusion function in two directions.

The light source B is inserted from the light source insertion hole 11, which is formed roughly at the center of the reflecting mirror section 10, and is installed such that the light source point F comes to a predetermined position (light source position) on the optical axis Ax with respect to the reflector 1.

For the various conditions, including the roughly rectangular outer shape of the reflector 1 (outer shape of the enclosure section 12), the installation angle of the lens 3 with respect to the optical axis Ax, and the installation position of the light source B, the present embodiment shows an example here, and generally these conditions are appropriately set considering the shape constraints imposed from the car body side, such as the capacity and shape of the lamp housing section on the car body, and the shape of the outer surface of the lamp (outer surface of lens) which continues with the other parts of the car body.

In FIG. 1, the reflector 1 and the lens 3, which constitute the vehicle lamp, are shown separately, and the shape of the reflective surface 10*a* is shown by partially cutting away the top side and the right side (in FIG. 1) portions of the enclosure section 12 of the reflector 1. Here in FIG. 1, a plurality of reflective surface elements 14 (see FIG. 2), which are laid out in an array and which constitute the reflective surface 10*a*, is not illustrated, and the surface shape thereof is roughly shown by the free curved surface 20 to be the basic shape of the reflective surface 10*a*.

The free curved surface 20 is a curved surface to be used for determining the basic shape of the reflective surface 10*a*, where a curved surface which satisfies predetermined conditions, such as the shape constraints, is selected as the free curved surface without using a single paraboloid of revolution as the basic shape.

The reflective surface 10*a* is configured by assigning a plurality of reflective surface elements 14 (individual separated part in rectangular shape, shown in FIG. 2) to each segment when the free curved surface 20, which is the basic shape, is sectioned into arrays, as shown in FIG. 2. In FIG. 2, the range of one reflective surface element 14 is shown by diagonal lines. The reflective surface 10*a* in the present embodiment has a structure where, the reflective surface 10*a* is sectioned into segments at a predetermined pitch for both the Y axis direction and the Z axis direction, which are perpendicular to each other, so that the shape of each segment corresponding to each reflective surface element 14 becomes the same rectangular shape when viewed from the X axis direction.

Figure 3:
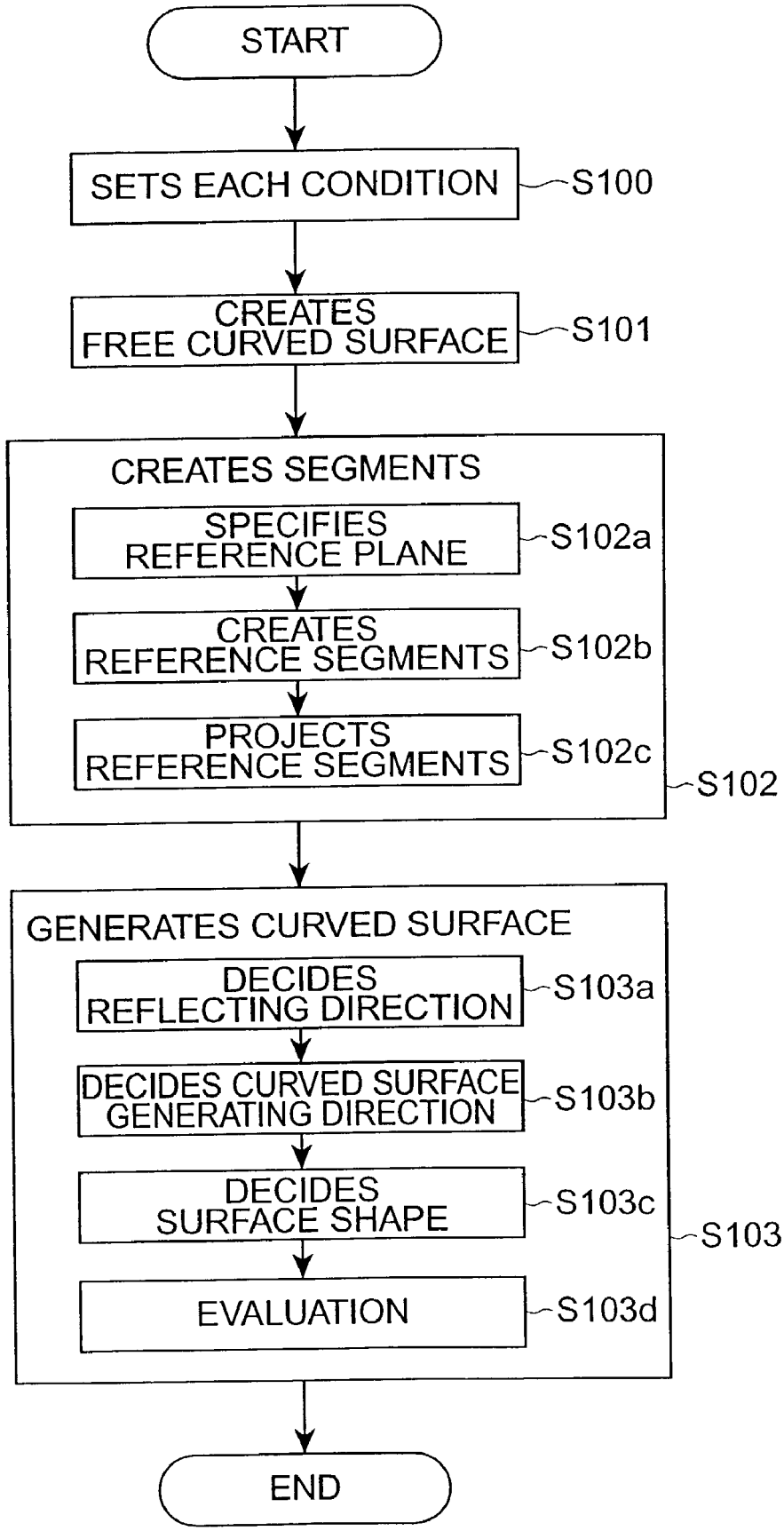
FIG. 3 is a flowchart showing an embodiment of a method of designing a reflective surface of a reflector in vehicle lamp.

The method of designing a reflective surface of a reflector in a vehicle lamp will now be described using the vehicle lamp with the above mentioned configuration as an example. FIG. 3 is a flow chart showing an embodiment of the method of designing a reflective surface of a reflector in a vehicle lamp according to the present invention.

The method according to the present embodiment comprises a condition setting step S100, free curved surface creating step S101, segment creating step S102, and curved surface generating step S103. The segment creating step S102 further includes a reference plane specifying step S102*a*, reference segment creating step S102*b*, and projection step S102*c*. The curved surface generating step S103 further includes a reflecting direction deciding step S103*a*, curved surface generation direction deciding step S103*b*, surface shape deciding step S103*c*, and evaluation step S103*d*.

Condition Setting Step (Step S100)

In the design of the reflective surface shape of the reflector in a vehicle lamp, various conditions required for the shape design are set first.

The conditions to be set are, for example, the position of the light source B to be installed and the position of the light source point F thereof (light source position), and an optical axis Ax which is an axis which passes through the light source position and which specifies the direction where the light from the light source is reflected by the reflective surface, and is emitted from the lamp. Other conditions may be set as necessary. In addition to each condition to be set, the shape constraints or other conditions from the car body side are imposed on the lamp or the reflector in advance.

Free Curved Surface Creating Step (Step S101)

Then the free curved surface 20, to be the basic shape of the reflective surface 10*a*, is created.

The free curved surface 20 is created to be a shape which satisfies the conditions from the functional aspect of the lamp and the shape constraints from the car body side. The conditions from the functional aspect demanded for the free curved surface 20 are, for example, the lighting uniformity with respect to the light reflection characteristic of the reflective surface 10*a*, and the functions to be required differ depending on the lamp. For these conditions, the shape of the free curved surface 20 is decided so as to satisfy the functions demanded for an individual lamp, referring to such conditions as the light source position (light source B and light source point F), and the optical axis Ax, which are set in the condition setting step S100.

It is also necessary to satisfy the shape constraints, such as slimming the lamp, so the functional conditions are optimized after satisfying the shape constraints. For example, when particularly strict shape constraints are imposed on a specific location of the reflector depending on the shape of the lamp housing section of the car body, the free curved surface 20 is created such that the drop in or change of the functional conditions at such a location is controlled.

Segment Creating Step (Step S102)

Then a plurality of segments 24 having a plurality of vertexes $\mathbf{25}_1$–$\mathbf{24}_4$ are created by sectioning the free curved surface 20. This segment creating step S102 includes a reference plane specifying step S102*a*, reference segment creating step S102*b*, and projection step S102*c*.

Reference Plane Specifying Step (Step S102*a*)

First a reference plane 5 is specified for the free curved surface 20 created in the free curved surface creating step S101.

Figure 4:
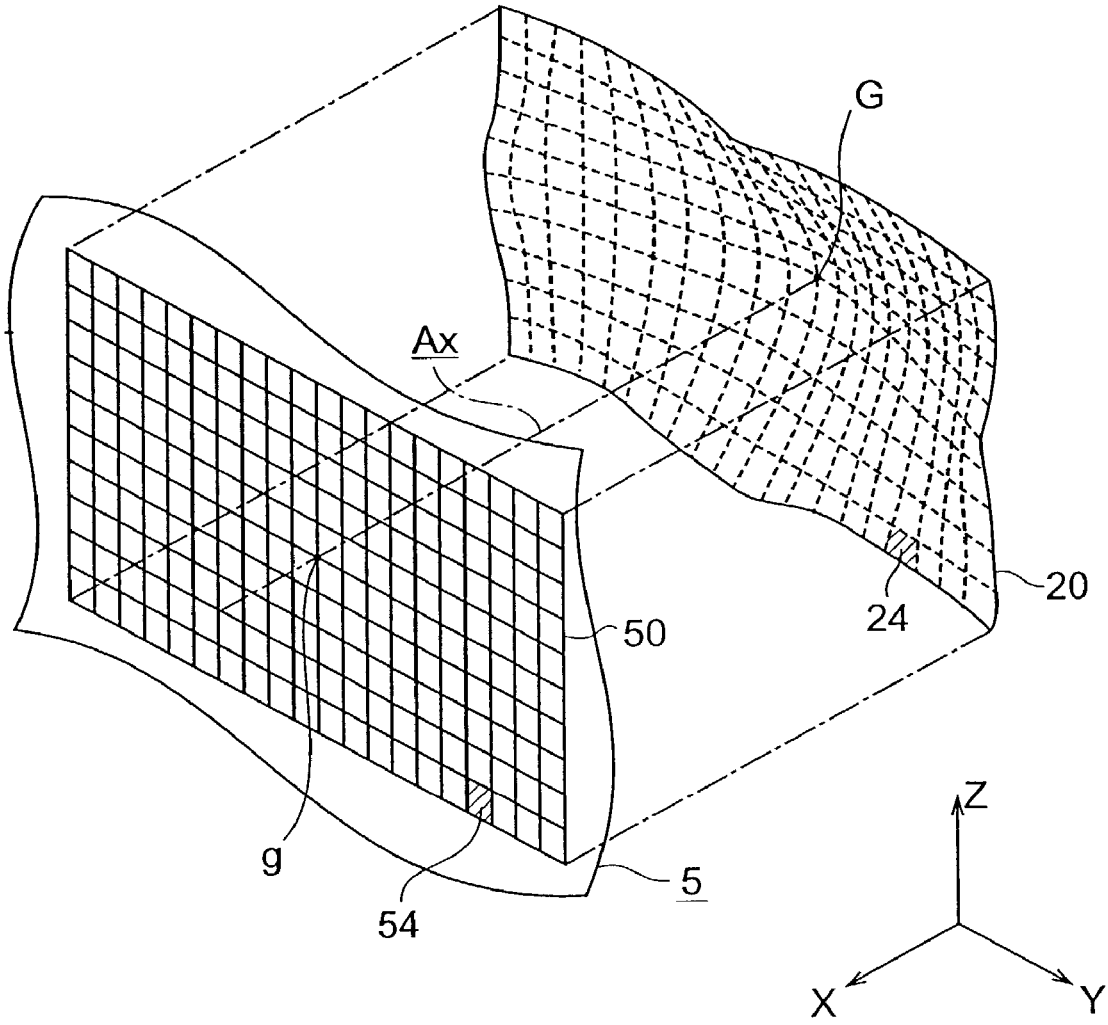
FIG. 4 is a perspective view showing a method for sectioning the free curved surface into arrayed segments using a reference plane.

FIG. 4 shows the reference plane 5 specified for the free curved surface 20. The reference plane 5 is a plane used for designing the later mentioned segments of the free curved surface 20, and is specified as a plane facing the free curved surface 20. In the present embodiment, the reference plane 5 is specified by the Y-Z plane, which is perpendicular to the optical axis Ax.

Reference Segment Creating Step (Step S102*b*)

Then a plurality of reference segments 54 are created using the reference plane 5 specified in the reference plane specifying step S102*a*.

First the reflecting plane outline 50 corresponding to the reflective surface 10*a*, which is created using the free curved surface 20 as the basic shape, is generated on the reference plane 5, including the point g corresponding to the point G on the free curved surface 20 to which the optical axis Ax passes through. The reference segment 54 is created by sectioning the inside of the outline of the reflecting plane 50 using a predetermined method.

In FIG. 4, the Y axis and the Z axis directions, which are perpendicular to the optical axis Ax respectively and are also perpendicular to each other, are the two sectioning directions, and the inside of the outline of the reflecting plane 50 is sectioned at a predetermined pitch in the respective directions to generate the rectangular reference segments 54 laid out in an array. The structure of the reference segments 54 corresponds to the array structure of the reflective surface element 14 of the reflector 1, shown in FIG. 2. The reference segments 54 maybe generated using a point other than the point g as a reference point for sectioning.

Projection Step (Step S102*c*)

Then segments 24 are generated by projecting the reference segments 54 created in the reference segment creating step S102*b* onto the free curved surface 20. Here the entire reference plane 5 is projected onto the free curved surface 20 along the X axis (optical axis Ax).

Figure 5:
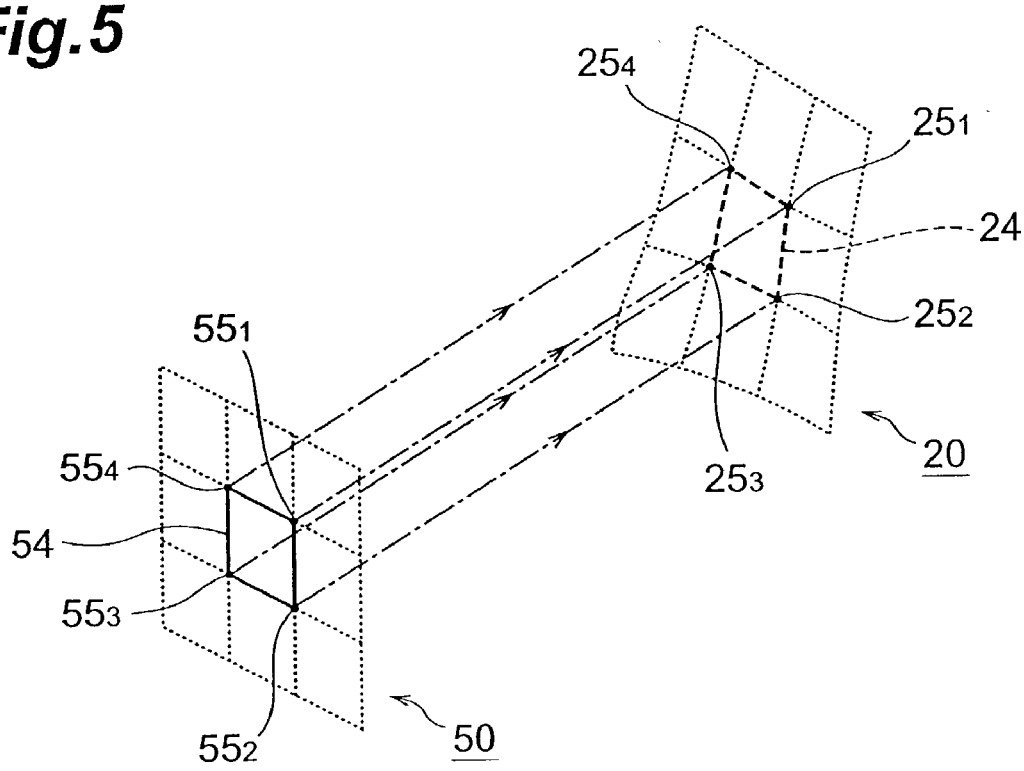
FIG. 5 is a perspective view showing the correspondence of the reference segments of the reference plane and the segments of the free curved surface, which is partially enlarged.

FIG. 5 is a perspective view showing the reference segment 54 in the outline of the reflecting plane 50 shown in FIG. 4, and the corresponding section on the free curved surface 20. In FIG. 5, one of the reference segments 54 is enlarged and shown by a solid line, and the corresponding segment 24 on the free curved surface 20 is shown by a broken line. And nearby reference segments are shown by a dotted line.

The number of vertexes $\mathbf{25}_1$–$\mathbf{25}_4$ of the segment 24 corresponds to the number of vertexes $\mathbf{55}_1$–$\mathbf{55}_4$ of the reference segment 54, and in this case there are four for each segment 24.

The vertexes $\mathbf{25}_1$–$\mathbf{25}_4$ of each segment 24 are used as points to determine the reflecting direction of the light for generating the curved surface to be assigned to each segment 24, as mentioned later.

Curved Surface Generation Step (step S103)

Then the curved surface as a reflective surface element 14 to be assigned to each segment 24 is generated. The curved surface generating step S103 includes the reflecting direction deciding step S103*a*, curved surface generation direction deciding step S103*b*, surface shape deciding step S103*c*, and evaluation step S103*d*.

Reflecting Direction Deciding Step (Step S103*a*)

Figure 6:
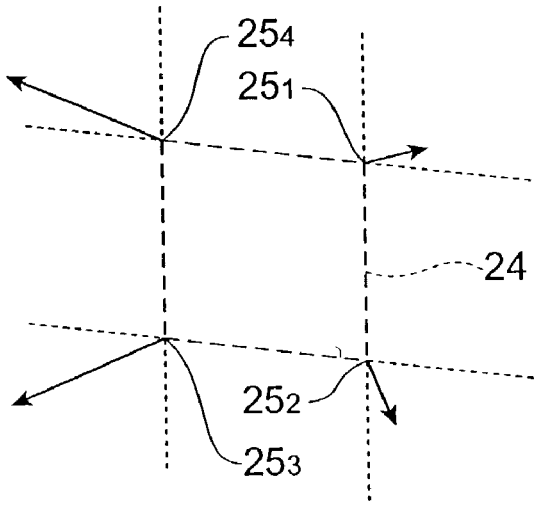
FIG. 6 is a diagram showing how the light reflecting direction is determined at each vertex of a segment.

First the reflecting direction of the light which enters from the light source B (shown by the arrow line in FIG. 6) is decided for each vertex $\mathbf{25}_1$–$\mathbf{25}_4$ of the segment 24 created in the segment creating step S102, as shown in FIG. 6.

The light reflecting direction at each vertex $\mathbf{25}_1$–$\mathbf{25}_4$ of the segment 24 is decided to be a desired direction for each vertex $\mathbf{25}_1$–$\mathbf{25}_4$ of each segment 24 within a range where the diffusion angle required for the entire lamp is satisfied.

The reflecting direction deciding step S103*a*, and the later mentioned curved surface generating direction deciding step S103*b*, surface shape deciding step S103*c*, and evaluation step S103*d*, are sequentially executed for each segment 24. And the decision of the reflecting direction, decision of the curved surface generating direction, decision of the surface shape, and evaluation, are executed for all the segments 24. By repeating these steps, the reflective surface element 14 is assigned to each segment on the free curved surface 20. The reference segment 54 and the segment 24, which are indicated by diagonal lines, correspond to the reflective surface element 14, indicated by the diagonal lines in FIG. 2.

Curved Surface Generation Direction Deciding Step (Step S103*b*)

First, two independent curved surface generation directions at each vertex $\mathbf{25}_1$–$\mathbf{25}_4$ for generating the curved surface to be assigned to the segment 24 are decided based on the reflecting direction at each vertex $\mathbf{25}_1$–$\mathbf{25}_4$ of the segment 24 decided in the reflecting direction deciding step S103*a*. The curved surface generating directions are naturally determined once the light reflecting direction at each vertex $\mathbf{25}_1$–$\mathbf{25}_4$ is decided.

Figure 7:
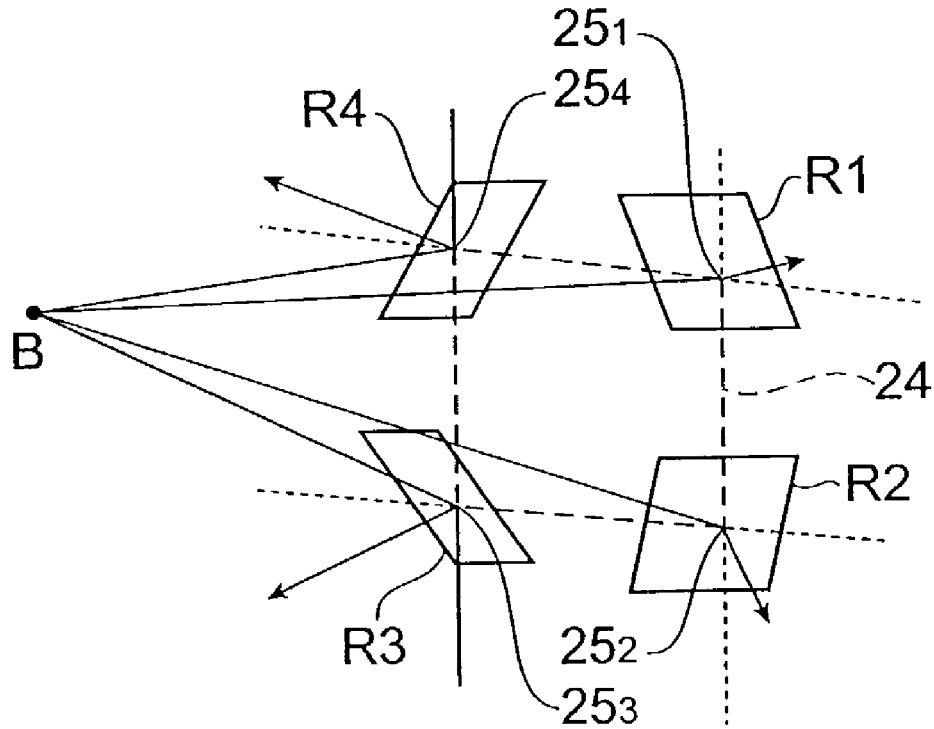
FIG. 7 is a diagram showing how to generate the reflective plane for reflecting light entered from the light source into the light reflecting direction at each vertex of a segment.
Figure 8:
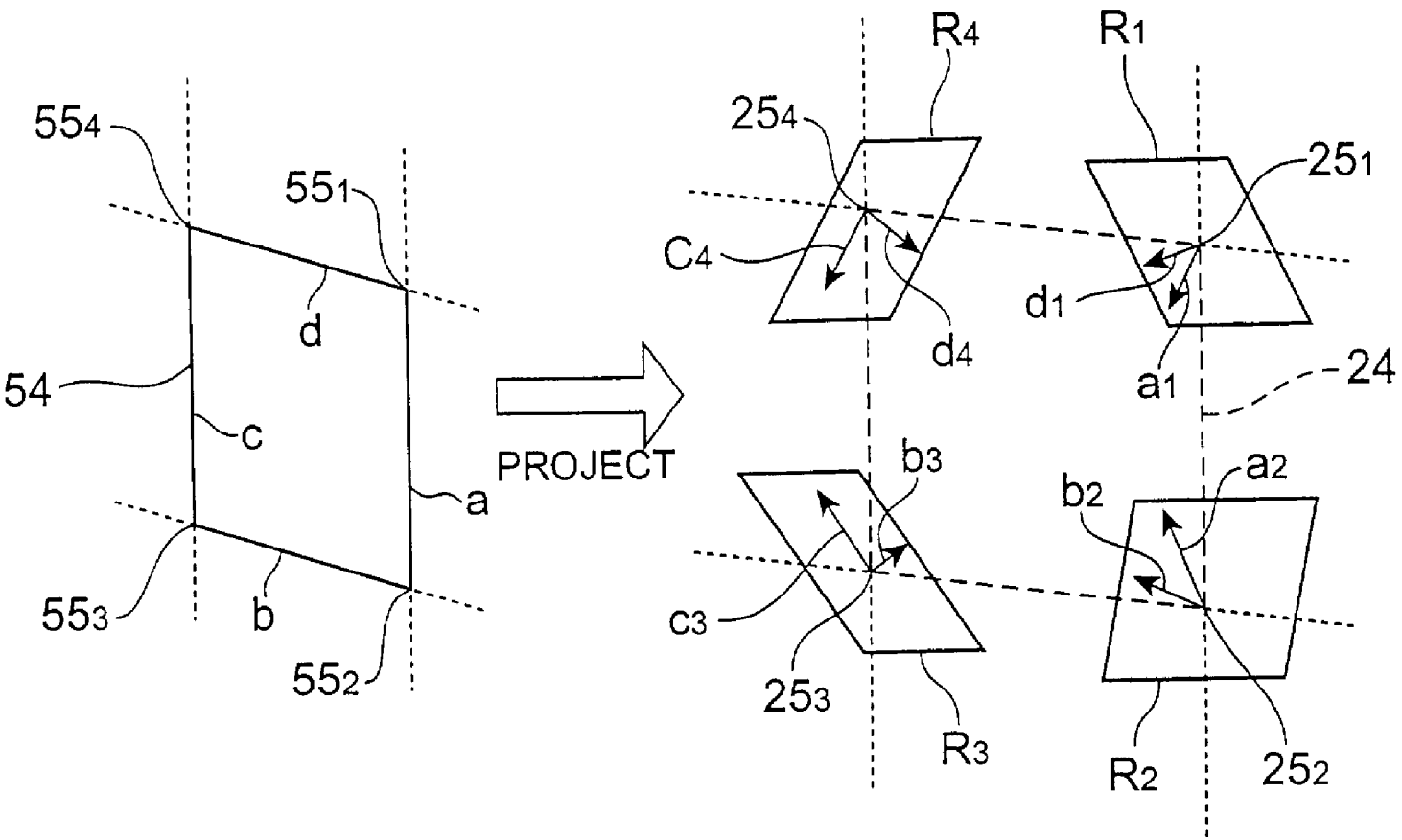
FIG. 8 is a diagram showing how to determine the curved surface generation direction by projecting the reference segment onto the reflective plane generated at each vertex of a segment.
Figure 9:
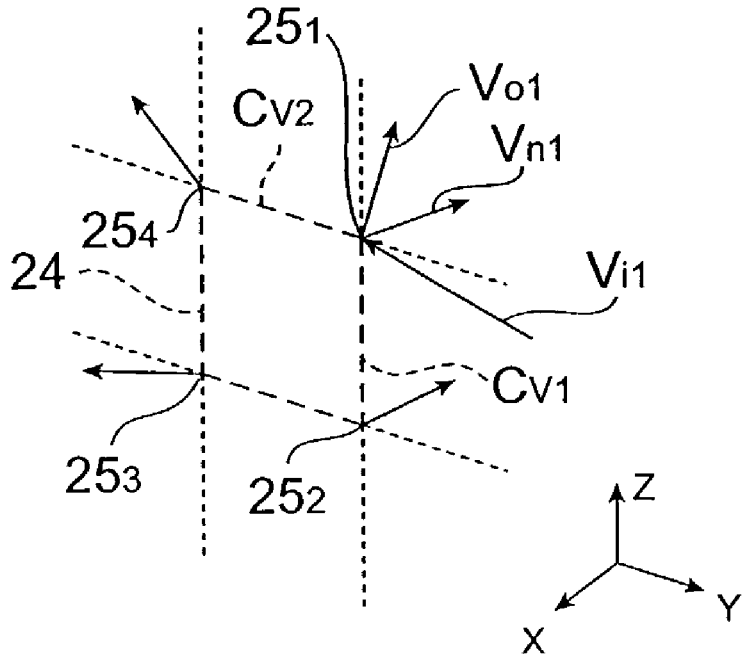
FIG. 9 is a diagram showing a method for determining the curved surface generation direction at each vertex when the free curved surface is sectioned by rectangular segments.

First, as FIG. 7 shows, the reflecting planes R1–R4 for reflecting the light from the light source B to the light reflecting direction at each vertex $\mathbf{25}_1$–$\mathbf{25}_4$ are determined. Then as FIG. 8 shows, the projection lines of the boundary lines a–d of the reference segment 54 to be projected on these reflecting planes R1–R4, when the reference segment 54 corresponding to the segment 24 is reflected on the free curved surface 20, are determined.

The directions of the projection lines $a_1$, $a_2$, $b_2$, $b_3$, $c_3$, $c_4$, $d_4$ and $d_1$ on the reflecting planes R1–R4, determined in this way, are decided as the curved surface generation directions at each vertex $\mathbf{25}_1$–$\mathbf{25}_4$ for generating the curved surface to be assigned to the segment 24. If the boundary line of the reference segment 54 is a curved line and the projection line to be projected onto the reflecting planes R1–R4 is a curved line, then the tangential directions at the vertexes $\mathbf{25}_1$–$\mathbf{25}_4$ of the curve are decided as the curved surface generation directions.

In this way, the curved surface generation direction at each vertex $\mathbf{25}_1$–$\mathbf{25}_4$ of the segment 24 can be decided. In the present embodiment, however, a rectangular segment is assumed as the reference segment 54, and as a coordinate system, Y axis and Z axis are set in the directions where the boundary line for sectioning the reference segment 54 stretches, as shown in FIG. 4, so the above mentioned curved surface generation direction can be determined quite easily as follows.

First the normal vector $v_{n1}$ of the reflecting plane for reflecting the light from the light source B in the reflecting direction at the vertex $\mathbf{25}_1$ is determined. This normal vector $v_{n1}$ can be determined by $$v_{n1}=(v_{o1}-v_{i1})/2 \tag{1}$$

Here, $v_{i1}$ is a unit vector to indicate the incidence direction of the light from the light source B, and $v_{o1}$ is the unit vector to indicate the light reflecting direction at the vertex $\mathbf{25}_1$.

Then the vector $v_{1a}$, which is perpendicular to the normal vector $v_{n1}$ and is perpendicular to the Y axis, is determined. This vector $v_{1a}$ can be determined by $$v_{1a}=v_{n1}\times v_y \tag{2}$$

Here $v_y$ is the normal vector of a plane which includes the boundary line $C_{v1}$ of the segment, and is perpendicular to the Y axis. Here "X" indicate the exterior product of the vector. This is the same hereafter.

Then the vector $v_{1b}$, which is perpendicular to the normal vector $v_{n1}$, and is perpendicular to the Z axis, is determined. This vector $v_{1b}$ can be determined by $$v_{1b}=v_{n1}\times v_z \tag{3}$$

$v_z$ is a normal vector of a plane which includes the boundary line $C_{v2}$ of the segment, and is perpendicular to the Z axis.

The directions of the vectors $v_{1a}$ and $v_{1b}$ determined in this way are decided as the curved surface generation directions at the vertex $\mathbf{25}_1$ for generating the curved surface to be assigned to the segment. This operation is performed for the other vertexes $\mathbf{25}_2$–$\mathbf{25}_4$ as well.

Figure 10A:
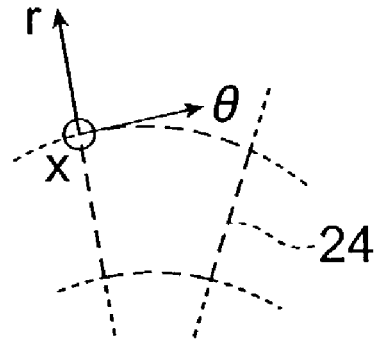
FIG. 10A is a diagram showing an example of setting the coordinate system for a sector-shaped segment.

When the sector shaped segment is assumed as the reference segment, and the coordinate system where the optical axis direction is X, the radial direction is r, and the circumferential direction is θ, as shown in FIG. 10A, is set as well, the above mentioned curved surface generation direction can be determined quite easily.

Figure 10B:
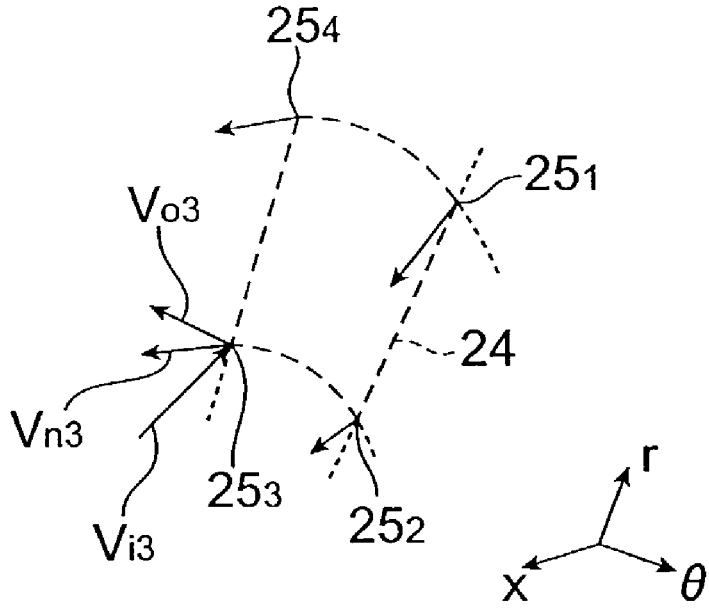
FIG. 10B is a diagram showing a method for determining the curved surface generation direction at each vertex when the free curved surface is sectioned by sector-shaped segments.

First, as FIG. 10B shows, the normal vector $v_{n3}$ of the reflecting plane for reflecting the light from the light source B in the reflecting direction at the vertex $\mathbf{25}_3$ is determined. This normal vector $v_{n3}$ can be determined by $$v_{n3}=(v_{o3}-v_{i3})/2 \tag{4}$$

Then the vector $v_{3a}$, which is perpendicular to the normal line vector $v_{n3}$, and is perpendicular to the r axis, is determined. This vector $v_{3a}$ can be determined by $$v_{3a}=v_{n3}\times v_r \tag{5}$$

$v_r$ is the normal vector of the plane perpendicular to the r axis.

Then the vector $v_{3b}$, which is perpendicular to the normal vector $v_{n3}$, and is perpendicular to the θ axis, is determined. This vector $v_{3b}$ can be determined by $$v_{3b}=v_{n3}\times v_\theta \tag{6}$$

Here $v_\theta$ is the normal vector of a plane perpendicular to the θ axis.

The directions of the vectors $v_{3a}$ and $v_{3b}$ determined in this way are decided as the curved surface generation direction at the vertex $\mathbf{25}_3$ for generating a curved surface to be assigned to the segment. This operation is executed for the other vertexes $\mathbf{25}_1$, $\mathbf{25}_2$ and $\mathbf{25}_4$.

Surface Shape Deciding Step (Step S103*c*)

Then the surface shape of the curved surface to be assigned to the segment 24 is decided based on the curved surface generating direction at each vertex $\mathbf{25}_1$–$\mathbf{25}_4$ of the segment 24 decided in the curved surface generation direction deciding step S103*b*.

Figure 11:
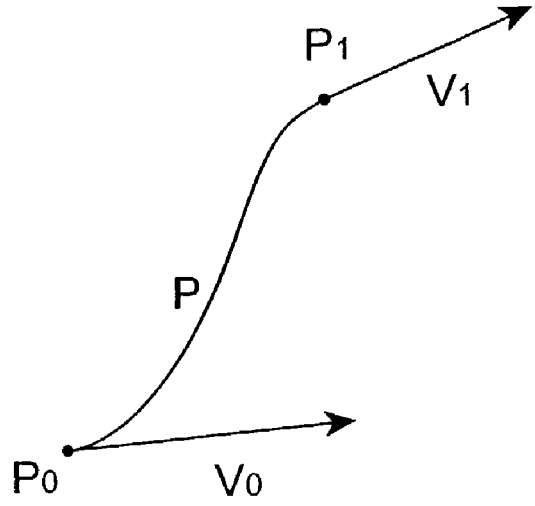
FIG. 11 is a diagram showing a Hermitean curve.

If the curved surface generation direction at each vertex $\mathbf{25}_1$–$\mathbf{25}_4$ of the segment 24 is determined, the outer curve connecting each vertex $\mathbf{25}_1$–$\mathbf{25}_4$ can be generated using the tangential spline curve or cubic Hermitean curve, for example. A Hermitean curve is a curve which is defined for interpolating a pair of vertexes of the segment when these vertexes and the derivative function there are provided. A Hermitean curve is normally a polynomial curve defined in the parameter block [0, 1]. A cubic Hermitean curve is defined by the end points $p_0$ and $p_1$ and the tangential vectors $v_0$ and $v_1$ thereof, as shown in FIG. 11. The formula is as follows.

$$P(t)=p_0H_0^3(t)+v_0H_1^3(t)+v_1H_2^3(t)+p_1H_3^3(t) \tag{7}$$

Here $H_1^3$ (t) is a polynomial called the cubic Hermitean function. Based on the conditions at both the end points $P_0$ and $P_1$ (t=0, 1), each Hermitean function is given as follows.

$$H_0^3(t)=(2t+1)(1-t)^2 \tag{8a}$$

$$H_1^3(t)=t(1-t^2) \tag{8b}$$

$$H_2^3(t)=t^2(1-t) \tag{8c}$$

$$H_3^3(t)=t^2(3-2t) \tag{8d}$$

Here the curve generation directions at each vertex $\mathbf{25}_1$–$\mathbf{25}_4$ of the segment 24 decided in the above mentioned curved surface generation direction deciding step S103*b* correspond to the directions of the tangential vectors $v_0$ and $v_1$. Therefore the outer curve connecting the vertex $\mathbf{25}_1$ and the vertex $\mathbf{25}_2$ can be decided by the cubic Hermitean function based on the curve generation direction $a_1$ at the vertex $\mathbf{25}_1$ and the curve generation direction $a_2$ at the vertex $\mathbf{25}_2$, for example, as shown in FIG. 8.

Figure 12:
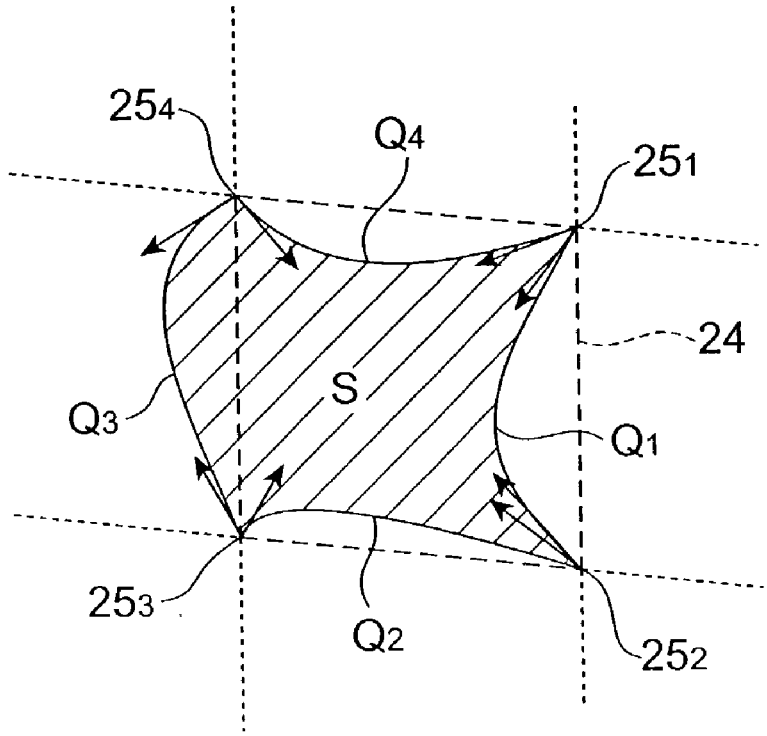
FIG. 12 is a diagram showing how to determine the surface shape based on the curved surface generation direction at each vertex of a segment.

In this way, the outer curves $Q_1$–$Q_4$ of the curve surface to be assigned to the segment 24 are decided as shown in FIG. 12. And the curved surface S is created based on the four outer curves $Q_1$–$Q_4$, and this curve S is decided as the surface shape of the curved surface to be assigned to the segment 24.

The surface shape of the curved surface to be assigned to the segment 24 can be simply decided by using Koonz's cubic hyperboloid, where the Hermitean curve is extended to the curved surface.

Figure 13:
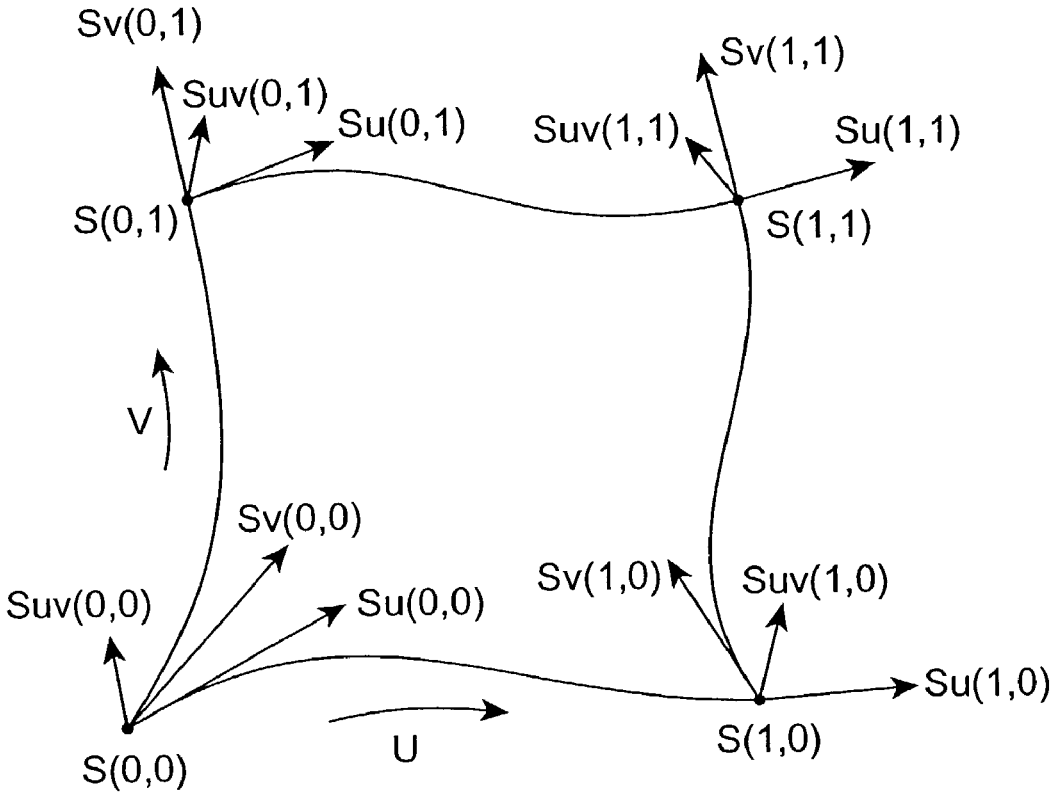
FIG. 13 is a diagram showing a cubic hyperboloid.

A cubic hyperboloid is a cubic polynomial curved surface which is defined by the vertexes of the segment, and the tangential vector and twist vector at the vertexes thereof, as shown in FIG. 13. The parameter area defined by the cubic hyperboloid is [0, 1] for u, and [0, 1] for v. The cubic hyperboloid is given as follows using the cubic Hermitean functions.

$$S(u,v)=[\,H_0^3(u)\quad H_1^3(u)\quad H_2^3(u)\quad H_3^3(u)\,]\begin{bmatrix} S(0,0) & S_v(0,0) & S_v(0,1) & S(0,1)\\ S_u(0,0) & S_{uv}(0,0) & S_{uv}(0,1) & S_u(0,1)\\ S_u(1,0) & S_{uv}(1,0) & S_{uv}(1,1) & S_u(1,1)\\ S(1,0) & S_v(1,0) & S_v(1,1) & S(1,1)\end{bmatrix}\begin{bmatrix} H_0^3(v)\\ H_1^3(v)\\ H_2^3(v)\\ H_3^3(v)\end{bmatrix} \tag{9}$$

here $$S_u(u,v)=\frac{\partial}{\partial u}S(u,v) \tag{10a}$$

$$S_v(u,v)=\frac{\partial}{\partial v}S(u,v) \tag{10b}$$

$$S_{uv}(u,v)=\frac{\partial^2}{\partial u\partial v}S(u,v) \tag{10c}$$

In other words, $S_u$ (u, v) indicates the tangential vector in the u direction at (u, v), and $S_v$ (u, v) indicates the tangential vector in the v direction at (u, v). $S_{uv}$ (u, v) is called the twist vector at (u, v), and indicates the way of twisting of the curved surface at that position.

The curved surface generation direction at each vertex $\mathbf{25}_1$–$\mathbf{25}_4$ of the segment 24 decided in the above mentioned curved surface generation direction deciding step S103*b* corresponds to the directions of the tangential vectors $S_u$ (u, v) and $S_v$ (u, v) in the u direction and v direction, and the directions of the normal vector $v_{n1}$ at each vertex $\mathbf{25}_1$–$\mathbf{25}_4$ corresponds to the direction of the twist vector $S_{uv}$ (u, v).

By using Koonz's cubic hyperboloid in this way, the surface shape of the curved surface to be assigned to the segment 24 can be decided simply.

Evaluation Step (Step S103*d*)

Figure 14:
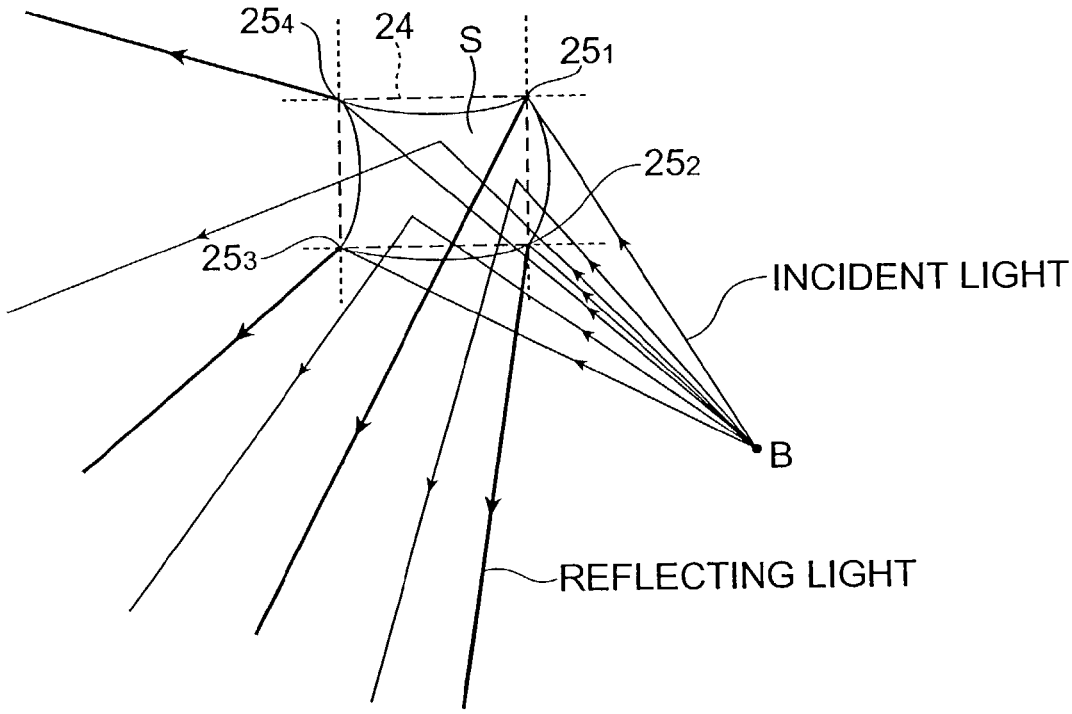
FIG. 14 is a diagram showing how the light from the light source is reflected by the curved surface S to be assigned to the segment in ray tracing.

Then the light reflection characteristics of the curved surface to be assigned to the segment are evaluated. In other words, as FIG. 14 shows, ray tracing is executed by computer simulation, and the light reflection characteristics by the generated curved surface are evaluated. In this way, the reflection characteristics of the curved surface, such as the light diffusion range and the density of rays, can be confirmed. The four thick lines shown in FIG. 14 shows the light reflecting direction at each vertex $\mathbf{25}_1$–$\mathbf{25}_4$ of the segment 24, and the other lights reflected by the curved surface S are contained in the range specified by these four thick lines.

In this way, the reflective surface element 14, having the surface shape decided in the curved surface generating step S103, is assigned to each segment 24, so as to create the reflective surface 10*a* which includes a plurality of reflective surface elements 14 where a free curved surface is the basic shape (see FIG. 2).

Figure 15A:
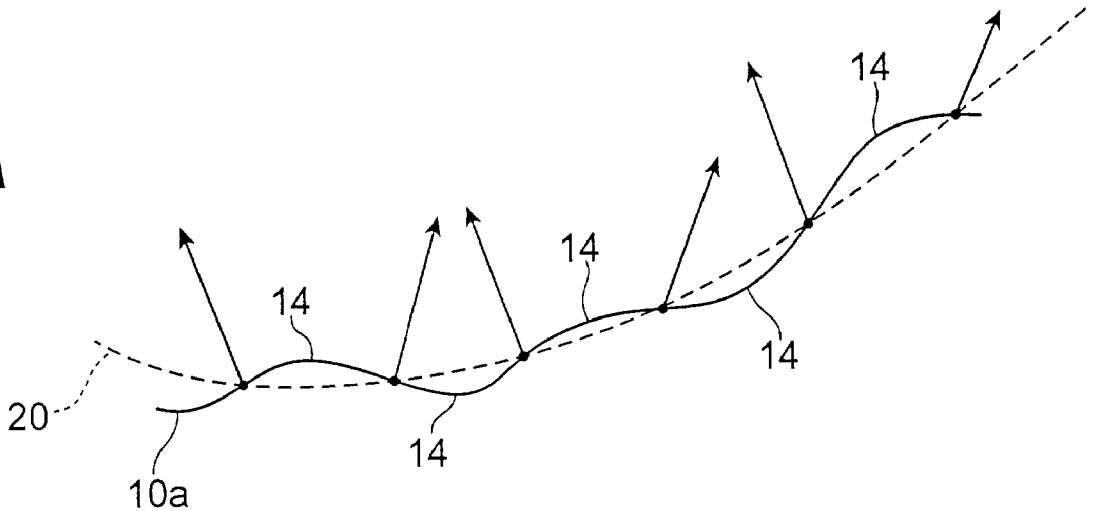
FIGS. 15A and 15B are diagrams showing a cross-sections of the reflective surface.
Figure 15B:
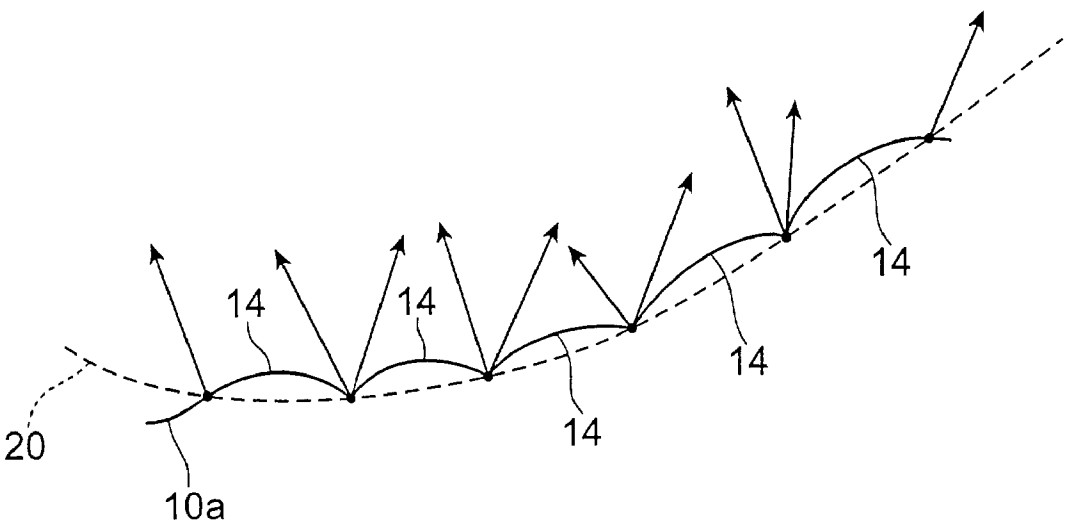

FIG. 15 is a diagram showing the cross-section of the reflective surface 10*a* created in this way. FIG. 15A shows the reflective surface 10*a* created when the reflecting directions are the same for a vertex shared by the adjacent segments 24 when the light reflecting directions at each vertex $\mathbf{25}_1$–$\mathbf{25}_4$ of this segment 24 are decided. FIG. 15B shows the reflective surface 10*a* created when the reflecting directions are different for a vertex shared by the adjacent segments 24.

If the reflecting directions are the same, as shown in FIG. 15A, the boundary of the reflective surface element 14 with the adjacent segment is continuous, and a smooth reflective surface 10*a* can be obtained as a whole. If the reflecting directions are different, as shown in FIG. 15B, then the boundary of the reflective surface element 14 with the adjacent segment is discontinuous, and a discontinuous reflective surface 10*a* can be obtained as a whole.

The functional effect of the method of designing a reflective surface of a reflector in a vehicle lamp described above will now be described.

The reflective surface shape which meets the various shape constraints can be implemented by making the basic shape of the reflective surface to be a free curved surface, but the shape of the free curved surface becomes complicated, so if a design method for assigning the geometric surface, such as a paraboloid of revolution, to each segment of the free curved surface as a reflective surface element is used, the controllability of the luminous intensity distribution pattern tends to be poor, since the flexibility of controlling the light reflecting direction is small.

In the case of the reflective surface design method according to the above mentioned embodiment, however, the light reflecting direction at each vertex of each segment of the free curved surface is decided first, and the curved surface to be assigned to each segment is generated based on this reflecting direction. By deciding the reflecting direction at each vertex of the segment to be a desired direction, and generating the curved surface based on this, the light reflecting direction at each segment can be controlled to be a desired range, and as a result, the controllability of the luminous intensity distribution pattern can be improved.

Especially when the surface shape of the curved surface to be assigned to the segment is determined, if the curved surface generation direction is decided based on the reflecting direction at each vertex $\mathbf{25}_1$–$\mathbf{25}_4$ of the segment 24 and the curved surface is generated based on this direction, then the curved surface to be assigned to the segment 24 can be generated easily. Also, if the surface shape of the curved surface to be assigned to the segment 24 is decided based on a cubic hyperboloid, then the curved surface can be generated very efficiently.

Also if the light reflecting directions at a vertex shared by the adjacent segments are the same, then the boundary of the reflective surface element 14 with the adjacent segment becomes continuous, and a smooth reflective surface 10*a* can be obtained. If the light reflecting directions at a vertex share by the adjacent segments are different, the boundary of the reflective surface element 14 with the adjacent segment becomes discontinuous, and a discontinuous reflective surface 10*a* can be obtained.

If the light reflection characteristics of the generated curved surface are evaluated, then the reflection characteristics, such as the diffusion range of light and the density of the beams, can be confirmed.

The method of designing a reflective surface of a reflector in a vehicle lamp according to the present invention is not limited to the above mentioned embodiment, but various modifications and changes in configuration are possible depending on the specific constraints imposed on an individual lamp.

Figure 16:
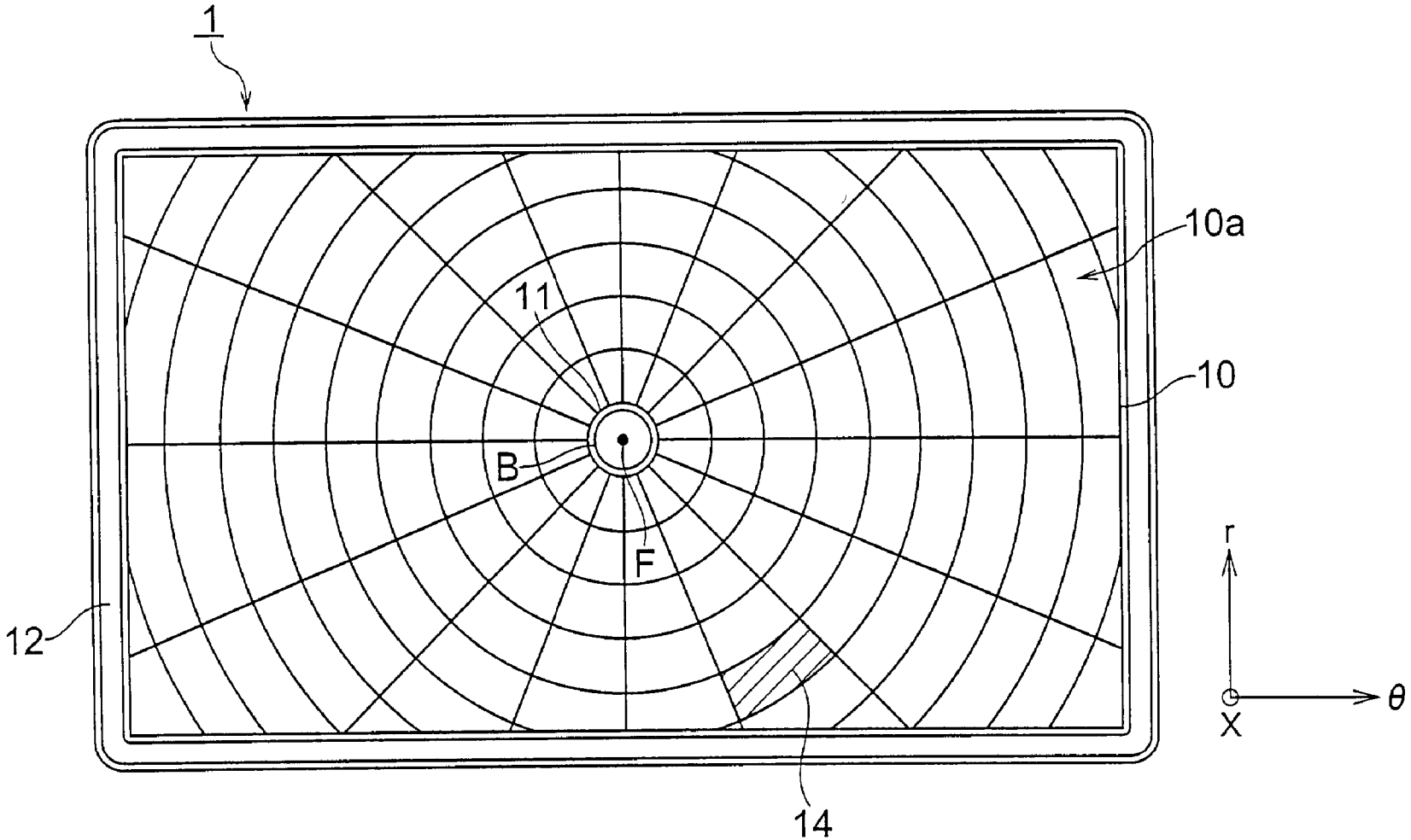
FIG. 16 is a plan view showing another example of the configuration of the reflector in vehicle lamp.

For example, the segment shape which sections the reflective surface 10*a* is not limited to the rectangles shown in the above mentioned embodiment. FIG. 16 is a plan view showing another configuration of a reflector in a vehicle lamp. In this example, the reference segment 54 is created by sectioning the inside of the outline of the reflecting plane 50 along the radial directions r, which are radially stretched from the intersection between the reference plane 5 and the optical axis Ax as the center, and along the circumferential directions θ which are concentric circles where the intersection is the center, the reference segment 54 is projected onto the free curved surface 20, and the shapes of the segment 24 and the reflective surface element 14 are set to be a sector when viewed from the X axis direction respectively.

In the case of this segment shape, the light reflecting directions at four vertexes of the sector are decided, just like the case of rectangles, and the curved surface generation direction at each vertex for generating the curved surface to be assigned to the segment is decided as described with reference to FIG. 10. And based on the curved surface generation direction at each vertex, the surface shape of the curved surface to be assigned to the segment is decided.

In the case of when the segment shape has shapes other than these as well, the above mentioned method can be applied in the same way. For example, not only the case when the segment is a polygon, such as a triangle or pentagon, but also the case when the segment is a segment having a plurality of vertexes but not a polygon, the above mentioned method can be applied.

The type of the lamp is also not limited to a marker light, but the above method can be applied to a reflector used for various types of vehicle lamps.

As described above, according to the method of designing a reflective surface of a reflector in a vehicle lamp of the present invention, the controllability of the luminous intensity distribution pattern of the lamp can be improved.

According to the above description on the present invention, it is clear that the present invention can be modified in various ways. Such variant forms do not depart from the spirit and scope of the present invention, but obvious improvements to the one skilled in the art shall be included in the following claims.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A method of designing a reflective surface of a reflector in a vehicle lamp, comprising:

a free curved surface creating step of forming a free curved surface;

a segment creating step of sectioning the free curved surface to create a plurality of segments which have a plurality of vertexes, each segment comprising multiple vertexes; and a curved surface generating step of deciding a light reflecting direction at each one of said plurality of vertexes and generating curved surfaces to replace said segments of said free curved surface based on said reflecting direction for each one of said plurality of vertexes, wherein values of the light reflecting direction at each of the vertexes of a given segment are used to calculate a shape of a curved surface to replace the given segment.

2. A method according to claim 1, wherein in said curved surface generating step, two independent curved surface generation directions at said vertex are decided to generate the curved surfaces to replace said segments based on said reflecting direction decided for said vertex, and the curved surfaces to replace said segment are generated based on said curved surface generation direction decided for each one of said plurality of vertexes.

3. A method according to claim 1, wherein in said curved surface generating step, the curved surface to replace said segment is generated based on a cubic hyperboloid.

4. A method according to claim 1, wherein for said vertex shared by adjacent segments, said reflecting directions are set to be the same.

5. A method for according to claim 1, wherein for said vertex shared by adjacent segments, said reflecting directions are set to be different.

6. A method according to claim 1, wherein in said curved surface generating step, the light reflection characteristics of the generated curved surface are evaluated.

7. A method according to claim 1, further comprising:

a reference plane specifying step of specifying a reference plane facing said free curved surface; and a reference segment creating step of specifying a reflecting surface outline on said reference plane, and creating a plurality of reference segments by sectioning the inside of said reflecting surface outline;

wherein said plurality of segments are created by projecting said plurality of reference segments onto said free curved surface.

8. A method according to claim 7, wherein in said reference segment creating step, the inside of said reflecting surface outline is sectioned in a first direction and in a second direction which is perpendicular to the first direction, so that said plurality of reference segments are created, wherein each one of said reference segments is a rectangle.

9. A method according to claim 7, wherein in said reference segment creating step, the inside of said reflecting surface outline is sectioned along the radial directions radially stretched from a predetermined position in said reflecting surface outline as the center, and the circumferential directions which are concentric circles where said predetermined position is the center, so that said plurality of reference segments are created, wherein each one of said reference segments is of a sector form.

10. A method according to claim 1, wherein each segment has more than two vertexes.

11. A method according to claim 1, wherein each segment defines a rectangular area of the reflective surface having four vertexes.

12. A method according to claim 1, further comprising:

determining reflecting planes for each of the determined light reflecting directions; and determining a plurality of projection lines on each of the reflecting planes.

13. A method of designing a reflective surface of a reflector in a vehicle lamp, comprising:

forming a free curved surface;

sectioning the free curved surface to create a plurality of segments which have a plurality of vertexes, each segment comprising multiple vertexes, and determining a light reflecting direction at each one of said plurality of vertexes and generating curved surfaces to replace said segments of said free curved surface based on said reflecting direction for each one of said plurality of vertexes, wherein values of the light reflecting direction at each of the vertexes of a given segment are used to calculate a shape of a curved surface to replace the given segment.

* * * * *